United States Patent [19]

Schäfer

[11] 4,135,572

[45] Jan. 23, 1979

[54] METHOD AND APPARATUS FOR THE ALTERNATE HEATING AND COOLING OF A HEAT EXCHANGER OF A HEATING AND COOLING SYSTEM

[76] Inventor: Otmar U. Schäfer, 9 Pienzenauerstrasse, Munich, Germany

[21] Appl. No.: 763,090

[22] Filed: Jan. 27, 1977

Related U.S. Application Data

[62] Division of Ser. No. 580,700, May 27, 1975, Pat. No. 4,026,347.

[30] Foreign Application Priority Data

May 27, 1974 [DE] Fed. Rep. of Germany ..... 2425589

[51] Int. Cl.[2] ..... F25B 13/00

[52] U.S. Cl. ..... 165/61; 165/104 S; 126/400

[58] Field of Search ..... 165/48, 61, 104 S, 18; 126/400, 271

[56] References Cited

U.S. PATENT DOCUMENTS

| | | | |
|---|---|---|---|
| 3,556,201 | 1/1971 | Sander | 165/2 |
| 4,072,184 | 2/1978 | Hinkle | 165/61 X |

FOREIGN PATENT DOCUMENTS 1013062 3/1957 Fed. Rep. of Germany.

*Primary Examiner*—Charles J. Myhre
*Assistant Examiner*—Margaret LaTulip

[57] ABSTRACT

A method and apparatus of alternately heating and cooling a heat exchanger of a heating and cooling system having a boiler and a cooler, is disclosed, in which quantities of liquid of different temperature are passed from the heat exchanger into at least two reservoirs, respectively during the warm-up phase and cool-down phases of the exchanger. Upon the change from cooling to heating, the quantity of liquid in the reservoir having the lowest temperature, is passed to the heat exchanger for preheating the latter, and upon the change from heating to cooling, the quantity of liquid in the reservoir having the highest temperature is passed to the heat exchanger for the preliminary cooling thereof. The quantities of liquid in each warm-up and cool-down phase respectively are circulated exclusively in closed circuits, by displacement, first between the heat exchanger and one of the reservoirs and thereafter between the heat exchanger and another of the reservoirs through the boiler during the warm-up phase and the cooler during the cool-down phase, while the entire quantity of liquid stored during the warm-up and cool-down phase, respectively are included in the subsequent cool-down and warm-up phase, respectively.

7 Claims, 10 Drawing Figures

Figure 1:
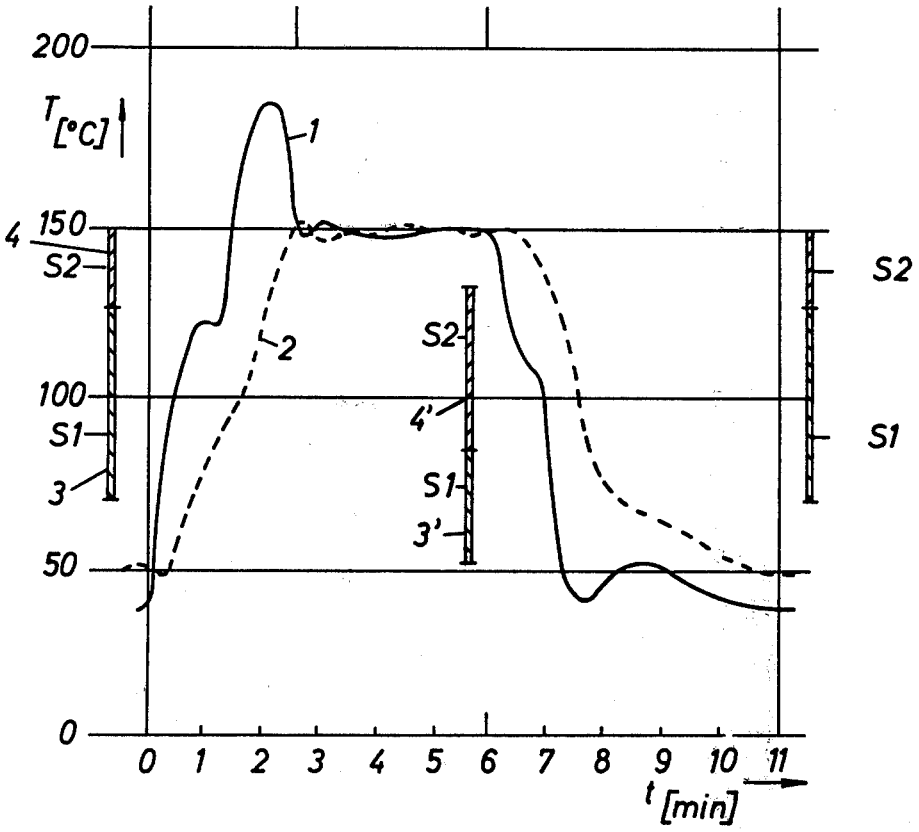

METHOD AND APPARATUS FOR THE ALTERNATE HEATING AND COOLING OF A HEAT EXCHANGER OF A HEATING AND COOLING SYSTEM

This is a division of application Ser. No. 580,700, filed May 27, 1975, now U.S. Pat. No. 4,026,347.

The invention concerns a method for the alternate heating and cooling of a heat exchanger, such as a press or a reaction vessel, of a heating and cooling system with heat recovery, in which quantities of liquid of different temperatures are carried from the heat exchanger into at least two reservoirs, or into one reservoir having at least two storage sections, both during the warm-up phase and during the cooling phase, from which, upon the change from cooling to heating, the quantity of liquid in the reservoir or storage section having the lowest temperature is delivered to the heat exchanger for the preheating of the latter, and, upon the change from heating to cooling, the quantity of liquid in the reservoir or storage section having the highest temperature is delivered into the heat exchanger for the precooling of the latter. The invention additionally relates to a heating and cooling system for the practice of this method.

In a known method and a known apparatus of this kind (U.S. Pat. No. 3,556,201), a plurality of reservoirs is present, each associated with a certain temperature range, and the liquid delivered from the heat exchanger, i.e., a press, is always put into the reservoir which has the temperature range of the liquid flowing out of the press. Since during the warm-up of the press the liquid flowing to the press (press lead flow) must necessarily have a higher temperature than the liquid flowing away from the press (press return flow), and in the cooling phase the circumstances must be just the opposite, the press lead flow, disregarding overlapping of the temperature ranges, is always connected in the various stages to a different reservoir than the press return flow. On this principle, therefore, liquid is, as a rule, being taken from one reservoir and at the same time liquid is being delivered to another reservoir. This means that the liquid level in the individual reservoirs varies within certain ranges, that is, that the expansion space is being distributed to a plurality of reservoirs of different temperature at continuously varying volumes. Consequently, only those liquids can be used as heat carriers at reasonable cost which operate without pressure, i.e., whose boiling point is above the maximum working temperature of the press. In the case of maximum working temperatures of 150 to 200° C., such as are common in the presses in question, water can no longer be used as a heat carrier, and oil, for example, is indicated, which has a substantially poorer thermal gradient than water.

When the temperature ranges overlap, i.e., when for example during a heating stage so much liquid has been fed to the press from the reservoir of a higher temperature level that the liquid flowing from the press has exceeded the temperature limit that is associated with the reservoir of the lower temperature level, when the liquid flowing out of the press is delivered to the same reservoir from which liquid is just being taken for the press. Insofar as this amount of liquid is concerned, however, it does not participate in heat recovery, because it is not utilized in the phase next following, i.e., in the cooling phase in the case under consideration. All stored amounts of liquid which participate either in the heating phase only or in the cooling phase only, but do not participate in one of the cooling phases following the heating phase or in one of the heating phases following the cooling phase, are lost with regard to the recovery of heat.

Lastly, the known process also has the disadvantage that it is time-consuming, especially when it is performed in more than two steps. The cause is to be seen in the fact that the reservoirs participating in the heat recovery (reservoirs for hot and lukewarm oil) are disposed exclusively in the lead flow of the press insofar as their action is concerned.

In another process which has been disclosed for the alternate heating and cooling of a press (German Federal Pat. No. 1,013,062), in addition to the press, a boiler and a cooler, a reservoir is provided, and the liquid is circulated according to the displacement principle during the warm-up phase in two steps between boiler, press, reservoir and boiler and between boiler, press and boiler, and during the cooling phase it is likewise circulated in two process steps, between cooler, press, reservoir and cooler, and between cooler, press and cooler. Although, inasmuch as the displacement principle is used in this process, operation with a liquid at temperatures above the boiling point is also possible in this case, and since the reservoir is disposed in the return flow of the press with regard to its action, the durations of the process can be substantially reduced in comparison to the first-named process, this process, too, is encumbered by great disadvantages. For if one operates with the short warm-up and cool-down times which are possible with this principle, for the purpose of achieving economical operation, such great temperature tensions occur within the press upon the changeover from cooling to heating or upon the changeover from heating to cooling, that damage can easily be produced, such as for example cracking of the press plates. Moreover, in this process only liquid of a temperature up to one-half of the difference between maximum and minimum temperature can be utilized for the heat recovery.

The invention is addressed to the problem, in a process or in an apparatus of the kind described in the introduction, of assuring that liquids whose maximum operating temperature is above the boiling point of the liquid can be used as heat carriers, that the heat recovery is improved in comparison to known installations, and even in the case of a shortening of the warm-up time and cool-down time, or in the case of an increase of the difference between maximum and minimum temperature, the heat exchanger will not be exposed to any unacceptable temperature tensions.

This problem is solved in accordance with the invention in that the amounts of liquid in each warm-up or cool-down phase is circulated exclusively in closed circuits, i.e., by the displacement principle, first between the heat exchanger and one of the reservoirs or reservoir sections, and in a later step of the particular phase between the heat exchanger and another of the reservoirs or reservoir sections including the boiler during the warm-up phase, and the cooler during the cool-down phase, and that the entire amount of liquid stored during the warm-up phase or cool-down phase, as the case may be, is included in the cool-down or warm-up phase, as the case may be, which follows.

In an especially advantageous process, a first reservoir and a second reservoir are present, and the liquid is circulated upon the changeover from cooling to heating in the circuit: first reservoir — heat exchanger — first reservoir (Circuit I), then in the circuit: second reservoir — boiler — heat exchanger — second reservoir (Circuit II), and lastly in the circuit: boiler — heat exchanger — boiler (Circuit III), and upon the changeover from heating to cooling it is circulated in the circuit: second reservoir — heat exchanger — second reservoir (Circuit IV), then in the circuit: first reservoir — cooler — heat exchanger — first reservoir (Circuit V), and finally in the circuit: cooler — heat exchanger — cooler (Circuit VI).

Preferably, the shifting from Circuit I to Circuit II is performed whenever the temperature of the water at the outlet of the heat exchanger has increased by approximately one third of the difference between maximum and minimum temperature; the changeover from Circuit II to Circuit III is performed whenever the amount of liquid in the second reservoir has been delivered to the boiler; the changeover from Circuit IV to Circuit V is performed whenever the amount of liquid in the second reservoir has been delivered to the heat exchanger, and the shifting from Circuit V to Circuit VI is performed when the amount of liquid in the first reservoir has been delivered to the cooler. In the latter case it is assumed that all reservoirs are of the same size. Their size is governed by the pumping capacity of the pump and by the capacity of the heat exchanger including the connecting lines between the boiler or cooler, as the case may be, and the heat exchanger, and between the heat exchanger and the reservoir. In practice, a reservoir size has been found expedient which corresponds approximately to three times the liquid capacity of the heat exchanger including the above-mentioned connecting lines.

In the solution provided by the invention, it is not the full amount of liquid usable for the recovery of heat, i.e., an amount of liquid up to temperatures corresponding approximately to midway between maximum and minimum temperature, that is collected in a reservoir, whose content is then delivered to the cooler in the cooling phase. Instead, a portion is delivered in the warm-up phase to a first reservoir, another portion to a second reservoir, etc., so that stored amounts of liquid of different temperature are available, one or more of which are used for precooling in the cool-down phase. Similar conditions apply to the reverse process. If two reservoirs are on hand, then, for example at a maximum operating temperature of 150° C. and a minimum operating temperature of 50° C., a portion of, for example, 50°–90° C. is delivered to the first reservoir, and a second portion of 90°–135° C. is delivered to the second reservoir, before changing over completely to the heating circuit. The portion in the second reservoir, i.e., from 90 to 135° C., is then used in the cool-down phase for preliminary cooling upon the changeover from heating to cooling, and the portion in the first reservoir, of 50° to 90° C., is delivered to the cooler as in the known process, before the normal cooling circuit is established. Since at the beginning of the cool-down phase the hot press is not supplied directly with liquid from the cooler, but first a preliminary cooling is performed with a liquid whose temperature averages only about one-third of the temperature difference between the maximum and minimum temperature below the heat exchanger which is at maximum temperature, no excessive temperature tensions occur. On the other hand, an amount of liquid of this temperature range can still be utilized for the recovery of heat. If three reservoirs are provided instead of two reservoirs, an additional step based on the principle of the invention can be performed.

A heating and cooling system in accordance with the invention, for the performance of the process described, is characterized by the fact that a first reservoir and a second reservoir are available, the first being able to be connected through the pump to the heat exchanger (Circuit I) or to be inserted into the cooling circuit (Circuit V), and the second being able to be connected to the heat exchanger (Circuit IV) or to be inserted into the heating circuit (Circuit II).

Another heating and cooling system in accordance with the invention, for the performance of the process described, is characterized by the fact that, where only one reservoir is used, the latter can be connected through the pump to the heat exchanger (Circuit I) or can be inserted into the heating circuit (Circuit II), and with reversed input and output can be connected to the heat exchanger (Circuit IV) or inserted into the cooling circuit (Circuit V).

Upon the ejection of the liquid from a reservoir, to prevent a commingling of the liquid coming from the heat exchanger with the liquid within the reservoir, it is necessary to provide a means for achieving a piston flow, such as a perforated baffle, in accordance with the inside diameter of the reservoir.

The invention will be further explained by an embodiment with the aid of 6 figures.

Figure 2:
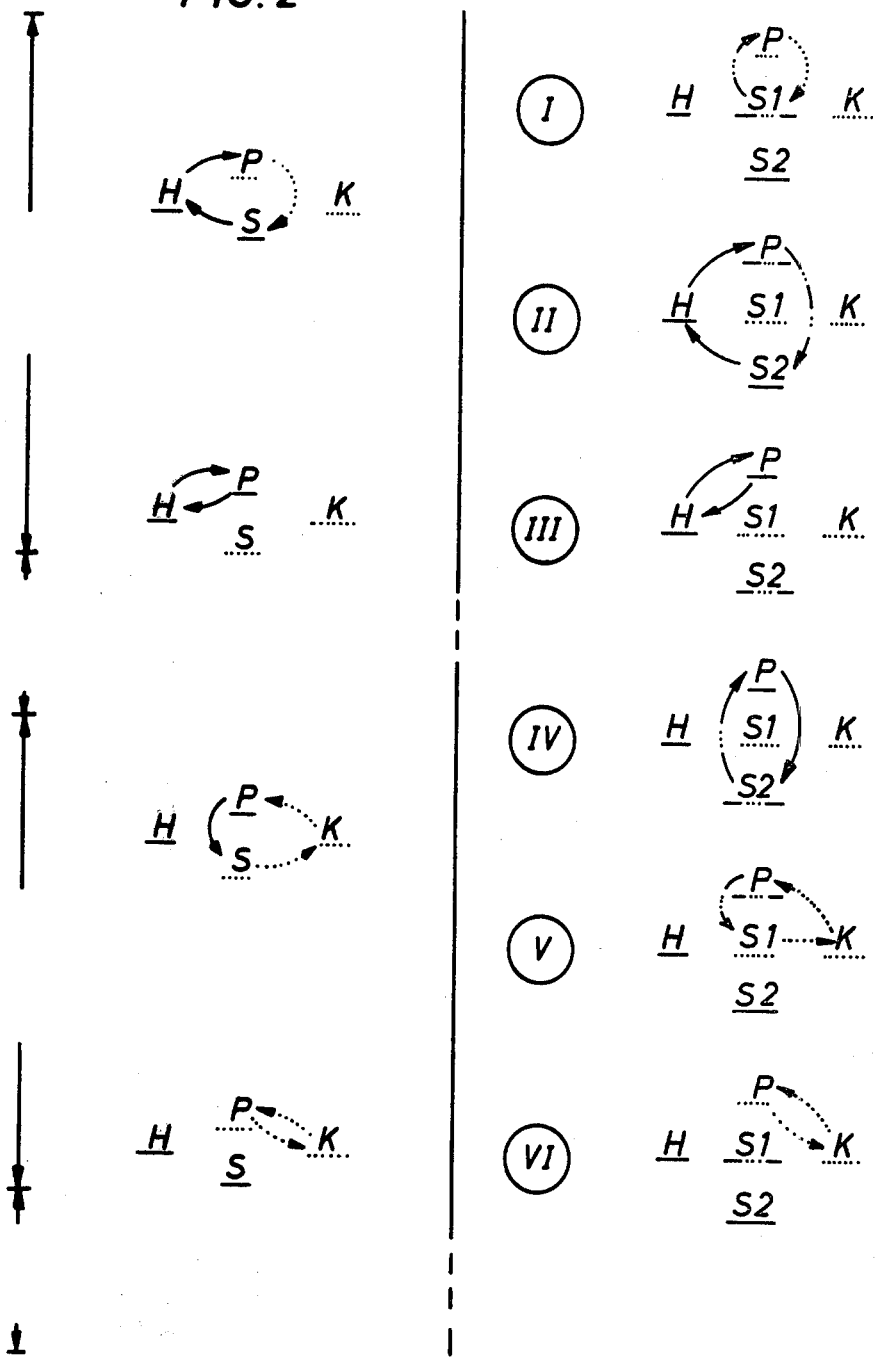
Figure 3:
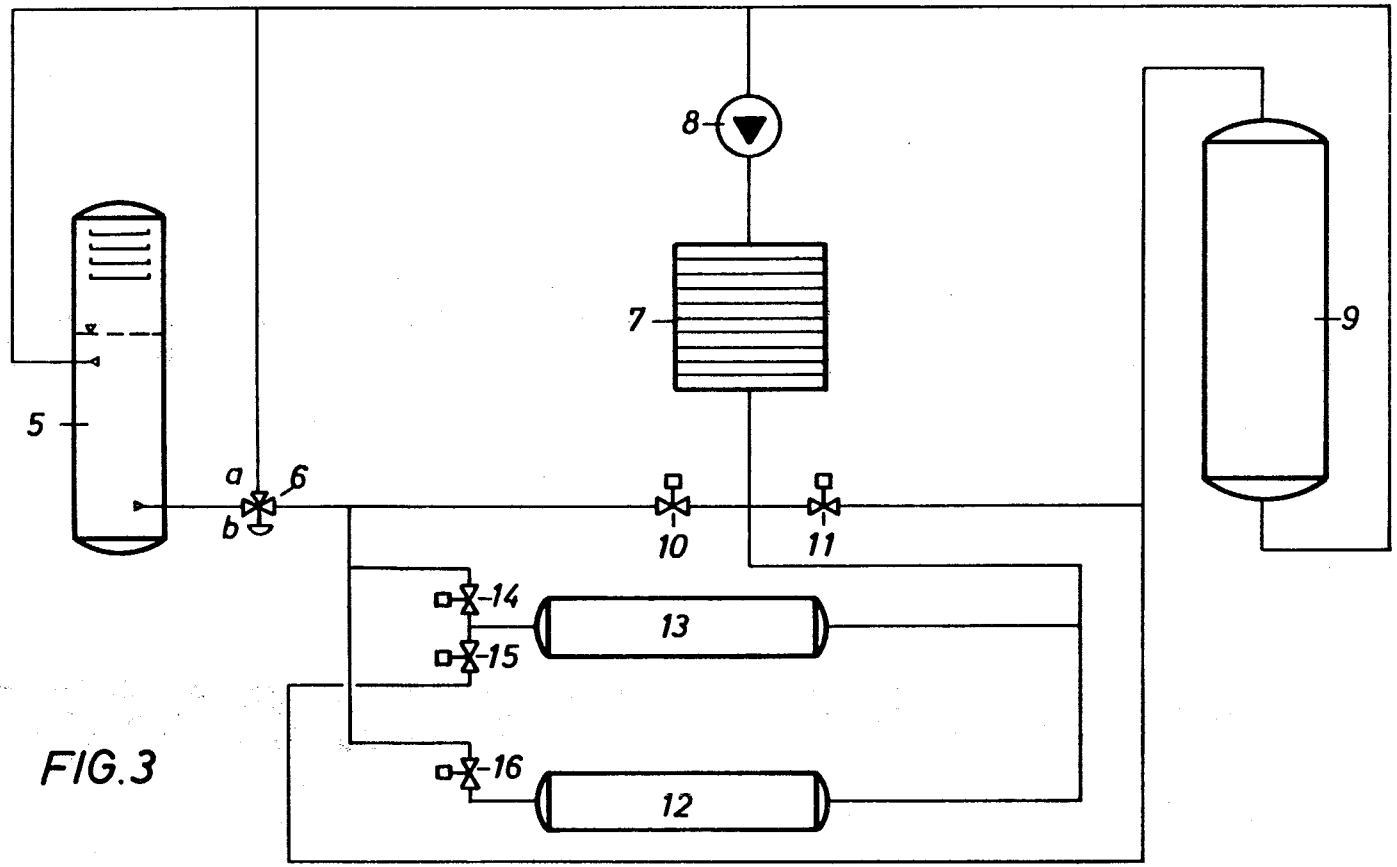
Figure 7:
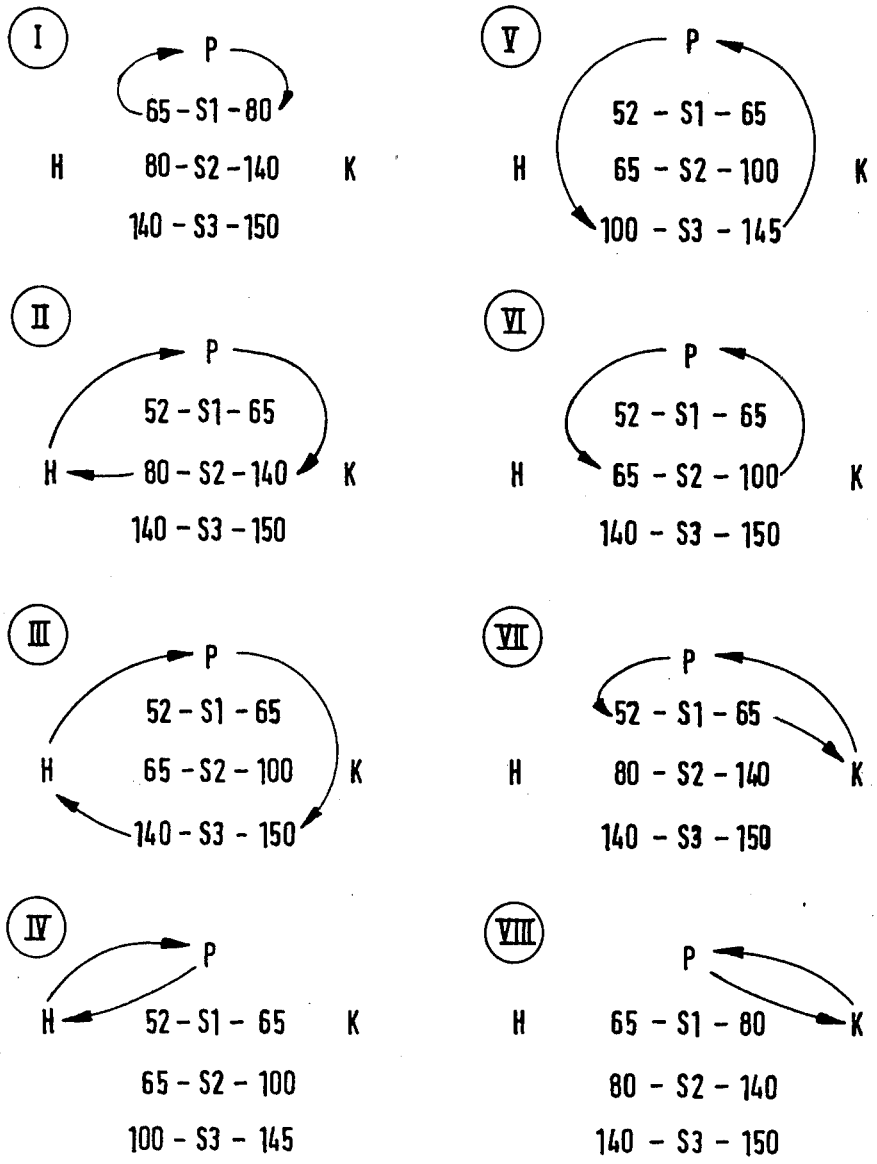
Figure 8:
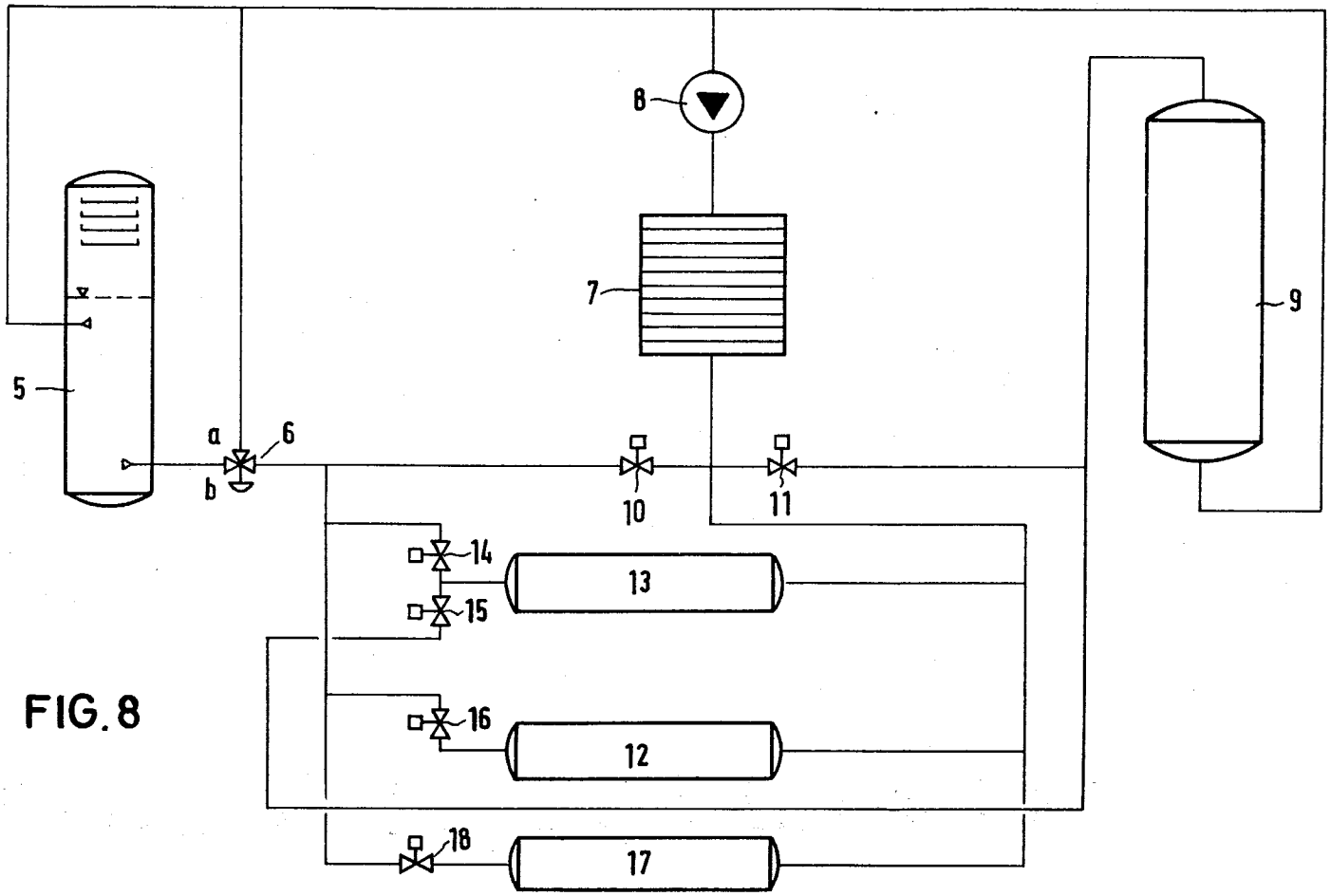

FIG. 1 shows the temperature curve of the water input temperature and the water discharge temperature of a heat exchanger of a heating and cooling installation, FIG. 2 shows schematically a comparison of the procedure of the known method in accordance with German Federal Pat. No. 1,013,062 with that of the process of the invention, FIG. 3 shows a heating and cooling system in accordance with the invention, having two reservoirs, FIGS. 4*a* and *b* show a portion of this system during various stages of the process, FIG. 5 shows a heating and cooling system in accordance with the invention, having one reservoir, FIGS. 6*a* and *b* show a portion of this system during various stages of the process, FIG. 7 is a schematic representation of the operation of a system of the invention having three reservoirs, and FIG. 8 shows a system in accordance with the invention having three reservoirs.

In the temperature diagram in FIG. 1 for a heat exchanger — a press in the present case — of a heating and cooling system, curve 1 represents the water temperature at the point of entry of the press and curve 2 the water temperature at the point of discharge from the press. A distinction is made between between three phases, namely between a warm-up phase in which the press is heated from a minimal temperature of 50° C. to a maximum temperature of 150° C., a heating phase in which the press is held at this maximum temperature, and a cool-down phase in which the press is cooled back down from this maximum temperature to the minimum temperature.

FIG. 2 shows diagrammatically, on the left side the procedure ued in the known method, and on the right side the procedure used in one embodiment of the invention. The key to the diagrams is as follows:

H = heating boiler
K = cooler
P = press

S = reservoir
S1 = first reservoir
S2 = second reservoir

The solid lines represent temperatures in the vicinity of the maximum temperature, the dotted lines temperatures in the vicinity of the minimum temperature, and the dash-dotted lines temperatures in a middle range between maximum and minimum temperature.

On the left-hand margin of FIG. 2 the ranges of the various phases are represented, the heating phase and the cooling phase occupying, of course, a much greater space in comparison to the warm-up and cool-down phase than is expressed in the drawing.

In the known process, upon the changeover from cooling to heating, i.e., at the beginning of the warm-up phase, the hot water from the boiler H displaces the cold water from the press P to the reservoir S, and at the same time its hot water stored from the preceding cool-down phase is delivered to the boiler. This procedure is continued at most until the temperature at the press discharge has reached the medium temperature between the maximum and minimum temperature — that is, in the example in FIG. 1, until a temperature of, say, 100° C. has been reached. Then the reservoir is again removed from the conventional heating circuit between boiler and press. It is filled with cold water. This step in the process is represented by the second line on the left side of FIG. 2. The press is heated up in this state to the required maximum temperature, and this state also is maintained during the heating phase. Upon the changeover from heating to cooling, a change is made to the cooling circuit in which the reservoir S is included. This state is represented by the third line on the left side of FIG. 2. In this case the cold water from the cooler K displaces the hot water from the press P to the reservoir S, and simultaneously this advances the cold water stored in reservoir S during the preceding warm-up phase to the cooler K. When the temperature of the water at the discharge from the press has dropped to approximately the medium temperature between the maximum and minimum temperature, the reservoir S is again taken out of the cooling circuit and the further cooling of the press is performed in the direct cooling circuit between press and cooler, as is represented in the fourth line on the left side of FIG. 2. The reservoir S is filled with hot water.

In the procedure of an example of the embodiment of the method of the invention, which is represented on the right side of FIG. 2, not four but six process steps are provided, which are designated I to VI. Instead of one reservoir S, two reservoirs S1 and S2 are provided, the first of which, S1, serves for the preliminary heating of the press at the beginning of the warm-up phase, and the second, S2, serves for the preliminary cooling of the press at the beginning of the cool-down phase. Upon the changeover from cooling to heating the reservoir S1 contains water of a medium temperature, and reservoir S2 contains water of a high temperature. The reservoirs have been charged in this manner in the preceding cool-down phase. The various temperature ranges are represented, on the one hand, by a solid line which is associated with the reservoir S2, and, on the other hand, by a dash-dotted line which is associated with reservoir S1. At the beginning of the warm-up phase, for the process step I, the liquid circuit associated with this process step is established. Water of medium temperature is forced from reservoir 1 into press P which contains cold water, and simultaneously the cold water is displaced from the press into the reservoir S1. In this manner the press P is prewarmed by means of water of a medium temperature and reservoir S1 is charged with cold water. The volume of reservoir S1 is in the present case approximately three times as great as the volume of the press including connecting lines, so that in the procedure represented in this step I a portion of the water originating from reservoir S1 flows back into the reservoir having been cooled by heat exchange with the press plate. Process step I is ended when the leading front of the cold water from press P has run through reservoir S1 and has arrived at the outlet from this reservoir. The press outlet temperature is then to have increased by about one third of the difference between maximum and minimum temperature.

The circumstances are also indicated in FIG. 1 in which columns 3 and 4 represent the temperature range of the water in reservoirs S1 and S2 in the various phases. At the beginning of the warm-up phase in the example represented, water is located in reservoir S1 with a temperature range between 70° C.and 128° C., and at the end of process stage I, the temperature range of the water in reservoir S1 is between 52° C. and 88° C. (cf 3' 1 in FIG. 1).

In process step II the now preheated press is connected to the boiler and the hot water from boiler H forces the return water of medium temperature from press P into reservoir S2 which contains hot water from the preceding cool-down phase. This [hot water] in turn is forced into boiler H. Reservoirs S1 and S2 are of the same size in his example. When all of the water of reservoir S2 has been pushed into boiler H, the temperature at the press outlet in the present case has resin to about 135° C., so that water of the temperature range from 88° to 135° C. is located in reservoir S2 at this moment. This is represented in FIG. 1 by the column 4'. The reservoir S2 is now removed again from the heating circuit and the circuit represented for process step III in FIG. 2 is established. In this condition the press is further heated until the maximum temperature is reached and this condition continues to be maintaind during the heating phase of the press, i.e., the phase in which the press is maintained at maximum temperature over a given length of time.

Upon the changeover from heating to cooling, at the beginning of the cool-down phase corresponding to process step IV in FIG. 2, the press P is connected to the reservoir S2 which contains water of a medium temperature, and this precools the press to a medium temperature, while reservoir S2 receives the hot water from the press. When the hot front of the water from the press has passed all the way through reservoir S2 to its outlet, this step of the process has ended. The reservoir contains in the present case water of a temperature ranging from 150 to 128° C. This range is represented by the temperature column 4 in FIG. 1.

In process step V of the cool-down phase, the pump is connected into the cooling circuit with the inclusion of reservoir S1, and then the water of medium temperature is forced out of press P by the cold water from the cooler into the reservoir S1 whose cold water is displaced into cooler K. When all of the cool water has been displaced from reservoir S1 into the cooler, reservoir S1 contains water of a temperature range from 128° to 70° (cf. temperature column 3 in FIG. 1), which is used in the warm-up phase, as described above, for the preheating of the press.

A comparison of the process described above, of an embodiment of the invention, with the known process (German Pat. No. 1,013,062) shows that not only are two reservoirs present instead of one reservoir, but also the one reservoir is used in each case for the preheating and the other reservoir for the precooling of the press, thereby preventing excessive temperature tensions upon rapid warm-up or cool-down, as the case may be, and on the other hand a greater temperature range can be utilized for heat recovery than in the known process.

If more than two reservoirs are provided, the gradation of the preheating and precooling can be made finer. In this case, in the changeover from cooling to heating, the reservoir with the lowest temperature is connected to the press for preheating and the content of the succeeding reservoir is displaced into the boiler. Upon the changeover from heating to cooling, the precooling takes place step-wise, first with the reservoir of the highest temperature, then with the reservoir of the next lower temperature, etc., and the reservoir content with the lowest temperature is displaced into the cooler. A preferred embodiment corresponding to these process steps is described with the aid of FIGS. 7 and 8.

FIG. 3 shows an embodiment of a heating and cooling system in accordance with the invention for the performance of the process represented on the right side of FIG. 2.

The system contains a heating circuit comprising a boiler 5 — in the present case the hot water reservoir of a heating circuit is shown —, a pump 8, a press 7, a reversing valve 10, a three-way control valve 6, and the corresponding connection lines which are not specifically identified. In addition, a cooling circuit is provided, which comprises a reservoir 9, the pump 8, the press 7, a reversing valve 11 and the corresponding connection lines. A first reservoir 13 can be connected by reversing valves 14 and 15 and corresponding connection lines with a press 7, or it can be inserted into the cooling circuit, and a second reservoir can be either connected to the press 7 or inserted into the heating circuit by means of a reversing valve 16 and suitable connection lines. By means of the valves the circuits represented in FIG. 2 on the right side, under I to VI, can be created as follows:

TABLE

| Valve / Stage | 6 | 10 | 11 | 14 | 15 | 16 |
|---|---|---|---|---|---|---|
| I | a open<br>b closed | closed | closed | open | closed | closed |
| II | a closed<br>b open | closed | closed | closed | closed | open |
| III | a closed<br>b open | open | closed | closed | closed | closed |
| IV | a open<br>b closed | closed | closed | closed | closed | open |
| V | a open<br>b closed | closed | closed | closed | open | closed |
| VI | a open<br>b closed | closed | open | closed | closed | closed |

In the table are shown the positions of the individual valves in the various process stages I to VI.

Figure 4A:
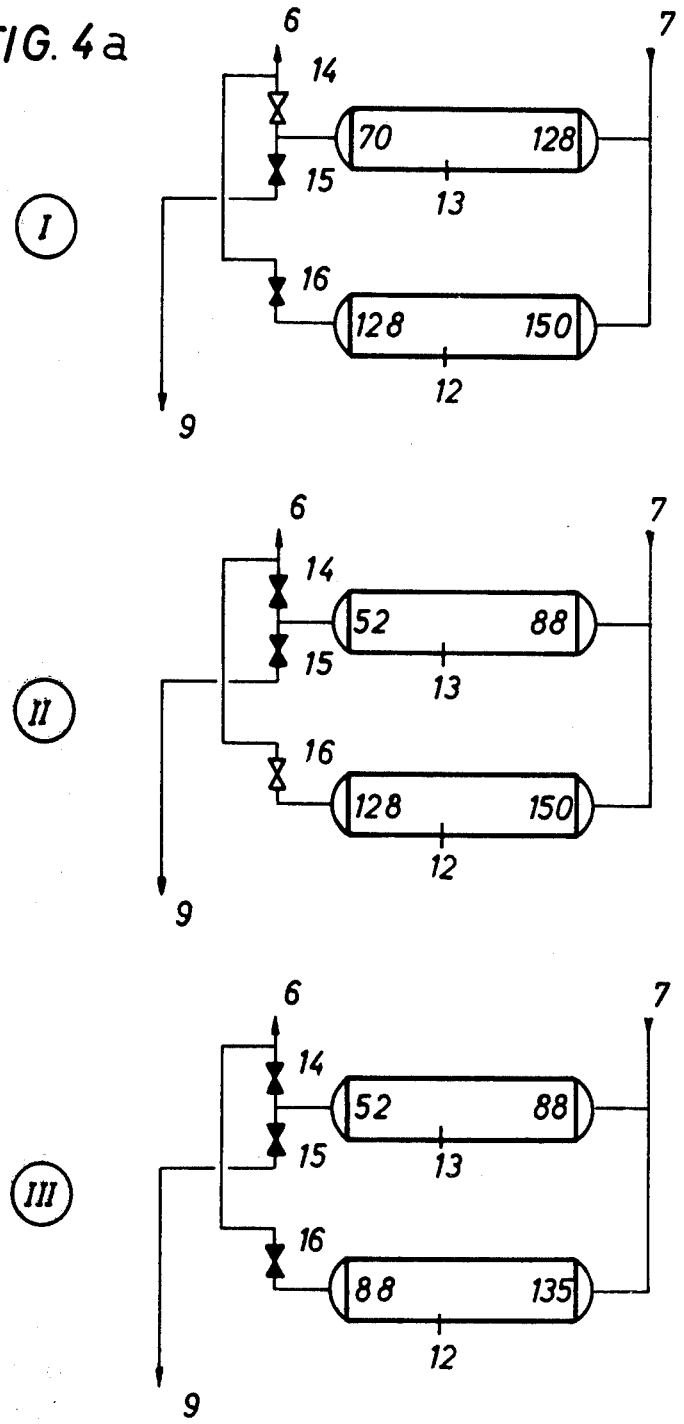
Figure 4B:
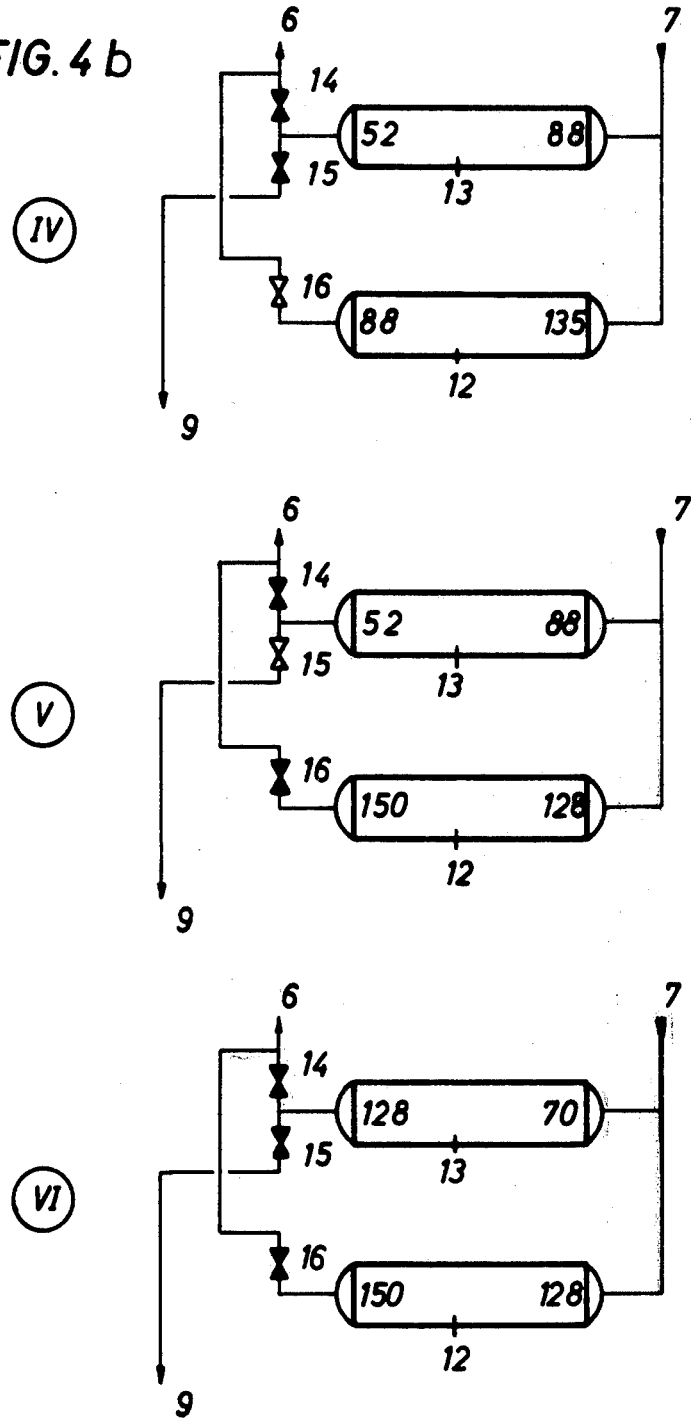
Figure 5:
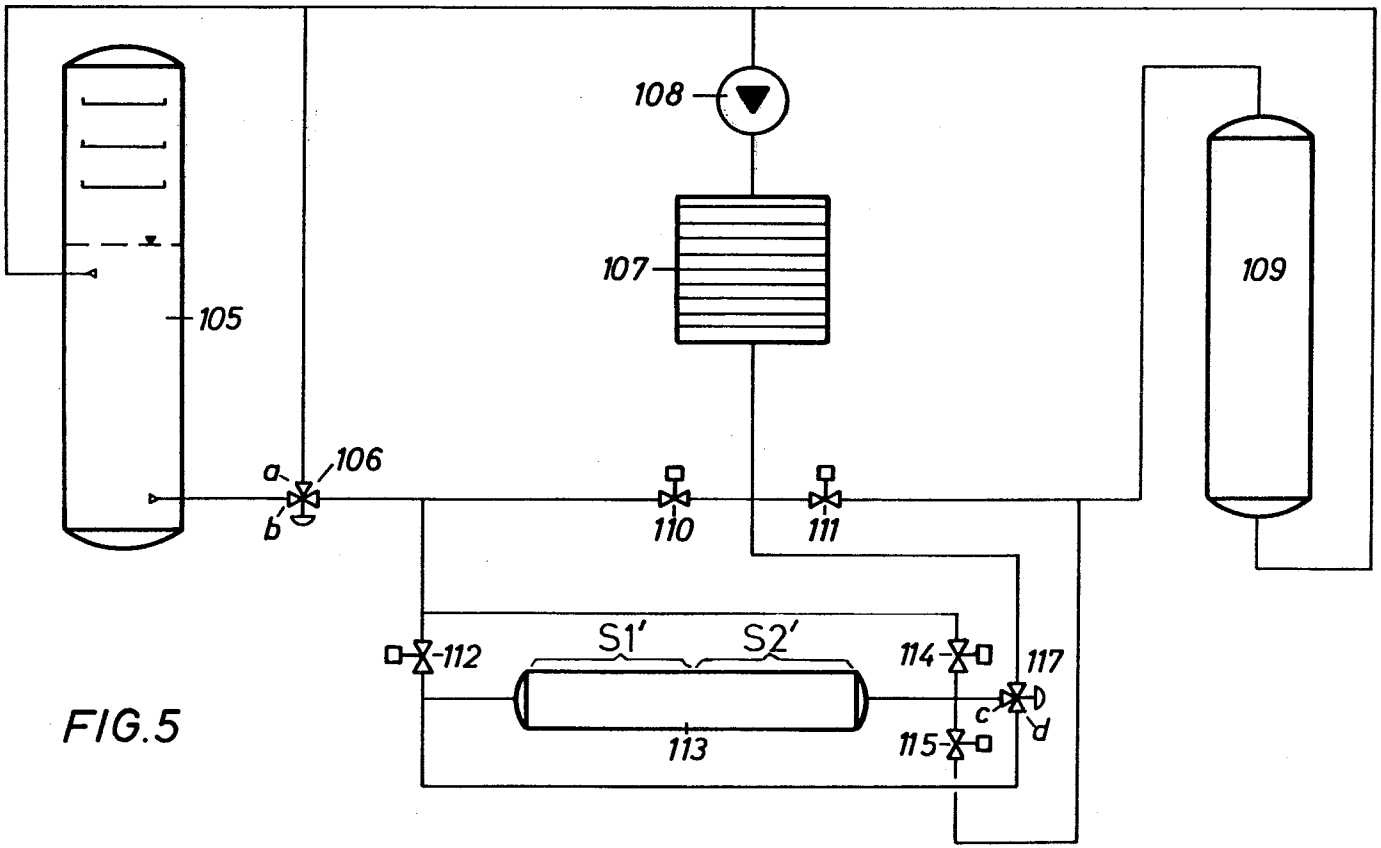

FIGS. 4*a* and *b*, in supplement thereto, shows the portion of the system shown in FIG. 3 comprising the two reservoirs 12 and 13 and the valves 14, 15 and 16, in process stages I to VI, the temperature range of the water contained in the reservoirs at the beginning of each process stage being also indicated. Closed valves are identified by black arrowheads, and open valves by white arrowheads.

In the embodiment described up to this point, two reservoirs are provided. It is also possible to perform the process of the invention with only a single reservoir if it contains two sections or areas in which amounts of water of different temperature are present, which are displaced in each case into the press, into the boiler or into the cooler. This will be explained further hereinafter with the aid of FIGS. 5 and 6.

The heating and cooling system represented in FIG. 5 has a construction similar to the one represented in FIG. 3. Parts which correspond to one another are given the same reference numbers to which 100 has been added. Instead of two reservoirs only one reservoir 113 is provided, which is imaginarily divided into two sections S1′ and S2′. A three-way valve 117 is additional provided.

Figure 6A:
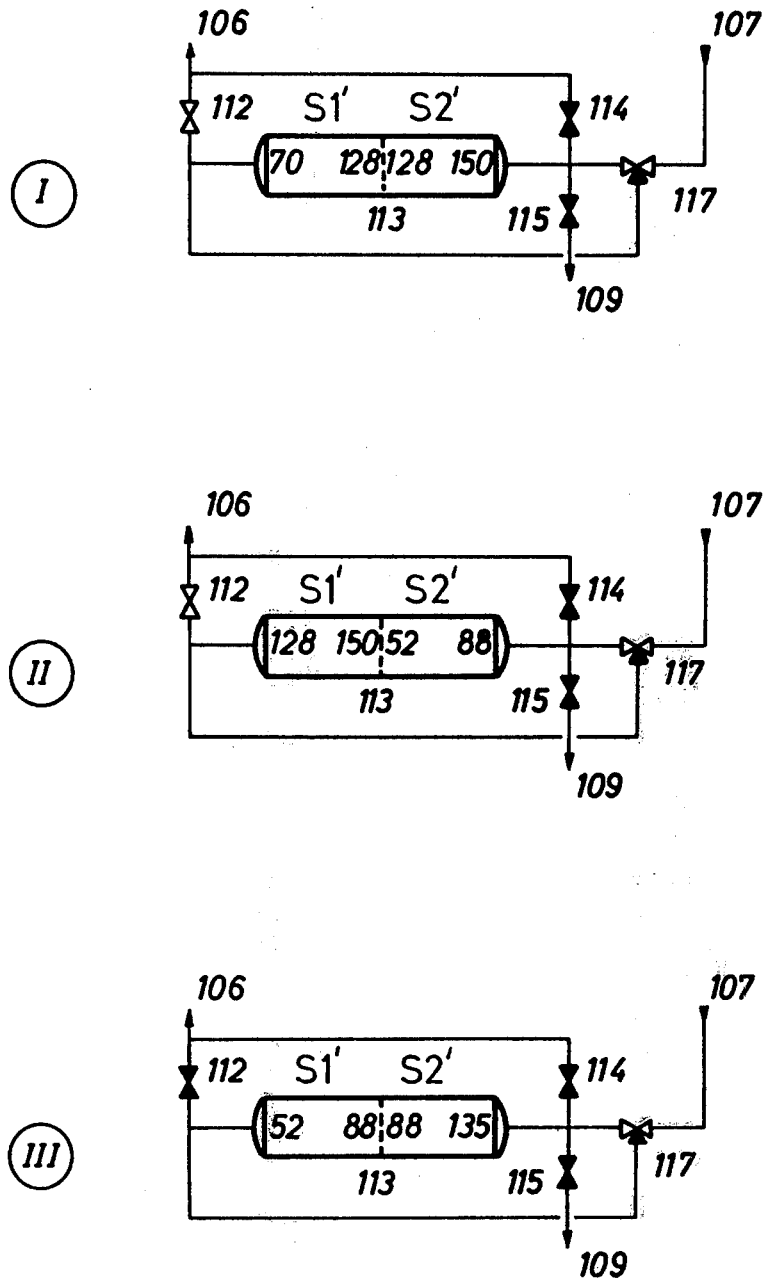
Figure 6B:
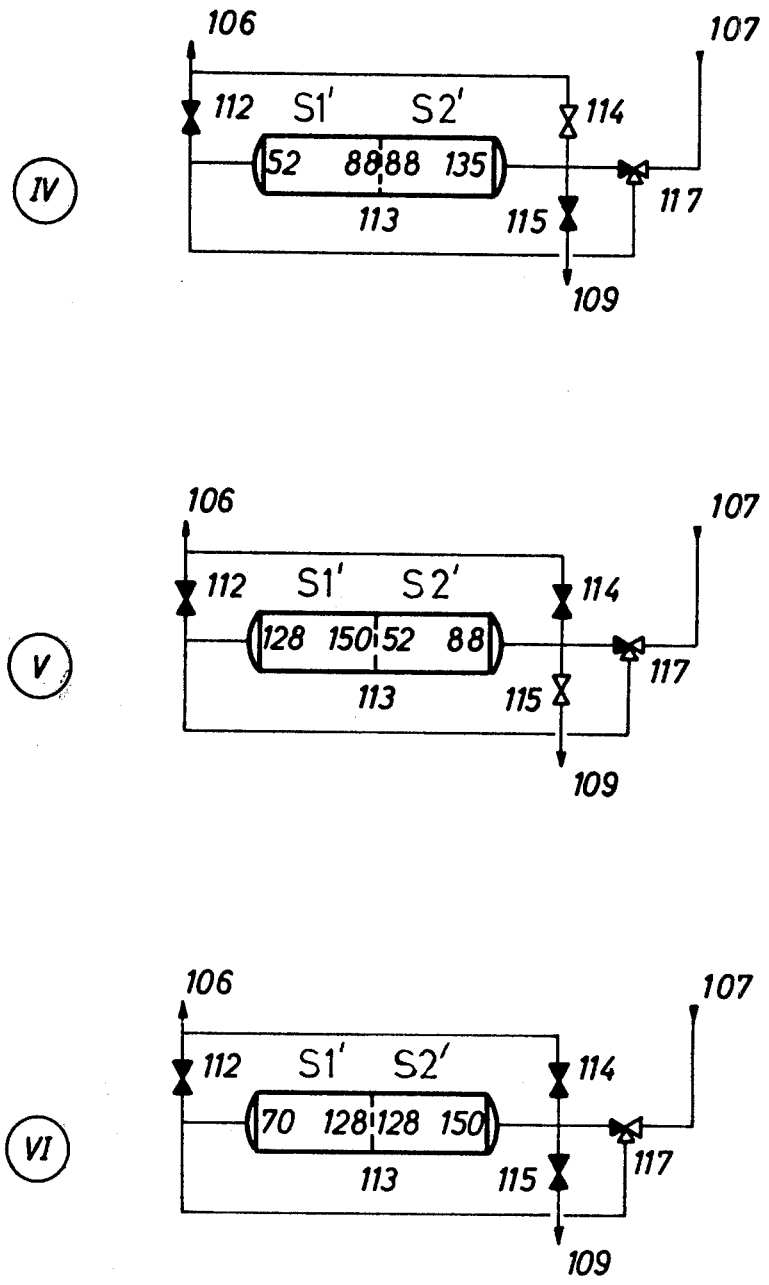

Like FIGS. 4*a* and *b*, FIGS. 6*a* and *b* show the six stages of the process of the invention in the system shown in FIG. 5. As in the case of FIGS. 4*a* and *b*, closed valves are represented by black double arrowheads and open valves by the white double arrowheads. In addition, the temperature ranges of the corresponding amounts of liquid are shown. The temperatures refer in each case of the initial state of the stage in question.

As FIGS. 6*a* and *b* indicate, the following six process steps are performed by appropriate operation of the valves.

I: The liquid of medium temperature stored in the left half of the reservoir 113 is delivered to the press 107 to preheat it, and at the same time the cold water in the press pushes the liquid of high temperature in the right half of reservoir 13 into the left half of the reservoir.

II: The high-temperature liquid in the left half of the reservoir 113 is displaced into the boiler 105, and the hot water of boiler 105 displaces the medium-temperature water of the press into the reservoir 113, thereby pushing the water of cold temperature from the right half of the reservoir to the left half of the reservoir.

III. With the reservoir excluded, the water is circulated directly in the heating circuit between boiler 105 and press 107.

IV. The medium-temperature water in the right half of the reservoir 113 is delivered to press 107 to precool the latter, and at the same time the hot water from the press displaces the liquid of cold temperature present in the left half of reservoir 113 into the right half of the reservoir.

V. The liquid of cold temperature in the right half of the reservoir 113 is delivered into the cooler 109 and the cold water from the cooler delivers the medium-temperature water from press 107 to the left side of the reservoir 113. The water of medium temperature thereby displaces the high-temperature water in the left half of the reservoir 113 into the right half of the reservoir.

VI. The cold water is circulated directly between the cooler 109 and the press 107 with the exclusion of the reservoir.

In the embodiments, only water is mentioned as the liquid. Other liquids, such as oil, can, of course, also be used as heat carriers. The reference to reservoir sections does not mean that spatially separate sections need to be present: instead, they may be imaginary sections or areas of a single tank. In multiple reservoir systems, the water of two adjacent temperature ranges only is to flow through each reservoir, that is to say, either water of medium and hot temperature or water of medium and cold temperature.

FIG. 7 illustrates diagrammatically the operation of a preferred embodiment of an installation in accordance with the invention having three reservoirs S1, S2 and S3. For comparison with the operation of the two-reservoir system represented in FIG. 2, the temperature ranges possessed by the liquid content of each reservoir at the beginning of each stage of the process are shown on each reservoir. The warm-up phase and the cool-down phase each comprise four process stages, or a total of eight stages. In detail, the process takes place as follows:

I. At the beginning of the warm-up phase, the reservoirs the the selected example contain liquids of the following temperature ranges:

S1: 65 to 80° C.
S2: 80 to 140° C.
S3: 140 to 150° C.

The liquid stored in reservoir S1 with a temperature of 65 to 80° C. is delivered to press P to preheat it, and at the same time the cold liquid in the press is displaced into the reservoir S1.

II. The liquid content of reservoir S2, of a temperature range of 80 to 140° C., is displaced into the boiler H and the hot water from the boiler forces the water from the preheated press P into the reservoir S2.

III. The liquid content of reservoir S3, of a temperature range of 140 to 150° C. is displaced into the boiler H and the water from the boiler forces the water from the press into reservoir S3.

IV. With the reservoir cut out, the water is circulated directly in the heating circuit between boiler H and press P. This state is maintained also during the heating phase after the press has been warmed up.

V. At the beginning of the cool-down phase, the amounts of liquid stored in reservoirs S1 to S3 have the following temperature ranges on the basis of process steps I to III:

S1: 52 to 65° C.
S2: 65 to 100° C.
S3: 100 to 145° C.

For the preliminary cooling of the press, the amount of liquid in reservoir S3 with a temperature range of 100 to 145° C. is delivered to the press P and simultaneously the hot water from the press is transferred to reservoir S3.

VI. The liquid content of reservoir S2, with a temperature range of 65 to 100° C., is delivered to the press P and at the same time the water in the press is displaced to the reservoir S2.

VII. The liquid content of reservoir S1, with a temperature range of 52 to 65° C., is delivered to the cooler K, and the cold water from the cooler displaces the water of medium temperature in press P into the reservoir S1.

VIII. With all reservoirs cut out, the water is circulated directly between cooler K and press P.

In a process using three reservoirs, the possible heat recovery can be further increased in comparison to a process using two reservoirs. At the same time, however, a lengthening of the time required for the process is involved therein. In order to improve the three-reservoir process in this respect, liquid of a higher temperature could be admixed in process stage I, for example, in order to raise the temperature level in the preheating and thus shorten the warm-up time.

FIG. 8 shows a system for the performance of the process represented in FIG. 7. In comparison to the system of FIG. 3, one additional reservoir 17 and one additional reversing valve 18 are provided. In the individual steps of the process the valves are to be set so as to produce the connections represented in FIG. 7.

I claim:

1. A heating and cooling system comprising a heat exchanger, a heating circuit with a boiler, a cooling circuit with a cooler, a single pump, first and second reservoir means, means for connecting said first reservoir means selectively to the heat exchanger and to the cooling circuit each via said single pump, and means for connecting said second reservoir means selectively to the heat exchanger and to the heating circuit.

2. A heating and cooling system comprising a heat exchanger, a heating circuit with a boiler, a cooling circuit with a cooler, at least one pump, first and second reservoir means, means for connecting said first reservoir means selectively to the heat exchanger and to the cooling circuit each via said pump, means for connecting said second reservoir means selectively to the heat exchanger and to the heating circuit, the capacity of said first and second reservoir means being three times that of the liquid content of the heat exchanger and said connecting means.

3. A heating and cooling system comprising a heat exchanger, a heating circuit with a boiler, a cooling circuit with a cooler, at least one pump, first and second reservoir means, means for connecting said first reservoir means selectively to the heat exchanger and to the cooling circuit each via said pump, means for connecting said second reservoir means selectively to the heat exchanger and to the heating circuit, a branch common to the heating and cooling circuit, said pump and said heat exchanger being located in said branch, reversing valves for closing the outlets of said reservoir means, and threeway control valve means for selectively connecting said reservoir means to said common branch directly and through the boiler, via said pump.

4. A heating and cooling system of claim 3, which comprises a reversing valve for connecting the outlet of said first reservoir means to the inlet of said cooler.

5. A heating and cooling system comprising a heat exchanger, a heating circuit with a boiler, cooling circuit with a cooler, at least one pump, first and second reservoir means, means for connecting said first reservoir means selectively to the heat exchanger and to the cooling circuit each via said pump, means for connecting said second reservoir means selectively to the heat exchanger and to the heating circuit, said reservoir means containing at the liquid inlet side.

6. A heating and cooling system comprising a heater exchanger, a heating circuit with a boiler, a cooling circuit with a cooler, at least one pump, first and second reservoir means, means for connecting said first reservoir means selectively to the heat exchanger and to the cooling circuit each via said pump, means for connecting said second reservoir means selectively to the heat exchanger and to the heating circuit, upon a change from cooling to heating in the use of said system, said connecting means forming a circuit I: first reservoir means-heat exchanger - first reservoir means, thereafter a circuit II: second reservoir means - boiler - heat exchanger - second reservoir means, and finally a circuit III: boiler - heat exchanger - boiler, and, upon a changer from heating to cooling in the use of said system, said connecting means forming a circuit IV: second reservoir means - heat exchanger - second reservoir means, thereafter a circuit V: first reservoir means - cooler - heat exchanger - first reservoir means, and finally in a circuit VI: cooler - heat exchanger - cooler, in all said circuits I to VI said pump being included.

7. A heating and cooling system according to claim 6, wherein said first and second reservoir means comprises a first and second storage section respectively of a common reservoir.

* * * * *

UNITED STATES PATENT AND TRADEMARK OFFICE

CERTIFICATE OF CORRECTION

PATENT NO. : 4,135,572

DATED : January 23, 1979

INVENTOR(S) : OTMAR SCHAFER

It is certified that error appears in the above-identified patent and that said Letters Patent are hereby corrected as shown below:

Claim 5, column 10, line 44, after "side"

insert -- a system for achieving a piston-like flow --.

Signed and Sealed this

*Twenty-second* Day of *May 1979*

[SEAL]

*Attest:*

RUTH C. MASON
*Attesting Officer*

DONALD W. BANNER
*Commissioner of Patents and Trademarks*